United States Patent [19]

Pershall

[11] Patent Number: 4,666,062

[45] Date of Patent: May 19, 1987

[54] DEVICE FOR MIXING AND SPRAYING A MIXTURE COMPOSED OF AT LEAST TWO COMPONENTS, SUCH AS LIQUIDS, AND A PROPELLANT

[75] Inventor: Faith Pershall, Innsbruch, Austria

[73] Assignee: F.P.D. Future Patents Development Company S.A., Luxembourg

[21] Appl. No.: 689,704

[22] Filed: Jan. 8, 1985

[30] Foreign Application Priority Data

Feb. 13, 1984 [DE] Fed. Rep. of Germany ..... 3405064
Jun. 6, 1984 [DE] Fed. Rep. of Germany ..... 84107423

[51] Int. Cl.[4] ..... B65D 83/14; B67B 7/46

[52] U.S. Cl. ..... 222/82; 222/83; 222/135; 222/136; 222/399; 222/402.1; 239/308; 239/309; 137/68.1

[58] Field of Search ..... 222/399, 5, 402.1, 402.18, 222/135, 136, 145, 82, 80, 81, 83, 83.5, 88, 129, 137, 190; 169/85, 88, 78; 239/308, 309; 137/68.1

[56] References Cited

U.S. PATENT DOCUMENTS

| | | | |
|---|---|---|---|
| 2,578,821 | 12/1951 | McBride | 239/308 X |
| 2,888,208 | 5/1959 | Fedit | 239/309 X |
| 2,947,315 | 8/1960 | Connell | 222/80 X |
| 3,040,991 | 6/1962 | Fedit | 222/153 X |
| 3,134,505 | 5/1964 | Modderno | 222/82 |
| 3,318,484 | 5/1967 | Modderno | 222/136 |
| 3,421,698 | 1/1969 | Baltzer | 239/304 |
| 3,540,623 | 11/1970 | Wittke | 222/136 X |
| 4,340,155 | 7/1982 | Obrist | 222/402.1 X |
| 4,469,252 | 9/1984 | Obrist | 222/399 X |

FOREIGN PATENT DOCUMENTS

| | | | |
|---|---|---|---|
| 268979 | 2/1969 | Austria | 239/308 |
| 0024659 | 8/1980 | European Pat. Off. . | |
| 0062817 | 10/1982 | European Pat. Off. . | |
| 0106280 | 10/1983 | European Pat. Off. . | |
| 0132511 | 4/1984 | European Pat. Off. . | |
| 2160268 | 6/1973 | Fed. Rep. of Germany . | |
| 1617825 | 5/1974 | Fed. Rep. of Germany . | |
| 1296099 | 5/1962 | France . | |
| 2310286 | 12/1976 | France . | |
| 2483892 | 12/1981 | France . | |
| 382075 | 11/1964 | Switzerland . | |

*Primary Examiner*—Joseph J. Rolla
*Assistant Examiner*—Edward S. Ammeen
*Attorney, Agent, or Firm*—Pahl, Lorusso & Loud

[57] ABSTRACT

A device for mixing and spraying a mixture composed of at least two components, such as liquids, and of a propellant, comprising two containers disposed within each other for receiving the components to be mixed and the propellant, and comprising a dispensing valve mounted on the outer container and including a movably mounted dispensing tube. The dispensing valve is adapted to act on a closure member of the inner container in such a way that the inner container may be broken open by normal actuation of the dispensing valve or the dispensing tube thereof. In order to achieve and maintain a defined fluid communication between the interior of the inner container and the interior of the outer container, the closure member of the inner container preferably includes a sealing cap adapted to be pushed or urged into the container opening by the dispensing tube of the dispensing valve. In the depressed condition, the sealing cap is locked by retaining ribs provided in the container opening to thereby establish fluid communication between the interior of the inner container and the interior of the outer container. Preferably, the closure member of the inner container is an integral part of the valve body of the dispensing valve.

16 Claims, 11 Drawing Figures

DEVICE FOR MIXING AND SPRAYING A MIXTURE COMPOSED OF AT LEAST TWO COMPONENTS, SUCH AS LIQUIDS, AND A PROPELLANT

BACKGROUND OF THE INVENTION

The invention is directed to a device for mixing and spraying a mixture composed of at least two components, such as liquids, and a propellant.

Devices of this type are used wherever different types of contents have to be stored separately and may be mixed only just before being used. As an example, hair dyes and the like shall be mentioned.

Such devices are subjected to the following requirements:

- constructional simplicity and correspondingly low manufacturing costs;
- easy and reliable manipulation;
- safe storage, i.e., especially any inadvertent mixing of the contents must be prevented;
- good mixing of the individual components.

For many applications, especially also in the case of hair dyes, it is desirable and even necessary that the mixture shall be dispensed in the form of an aerosol or foam. For these cases nothing but an aerosol device of the specified kind (spray container) is possible. There is a wide range of prior art devices which have proven more or less reliable in practise. As regards a discussion of this prior art, reference shall be made to the European Patent Application No. 82 102 599.6 published under the number 0062817, in which a further improvement of the prior art mentioned therein is described and claimed. Said improvement is characterized in that the inner container is configured as an independent aerosol container including a separate dispensing valve, wherein the inner container is subjected to a higher internal pressure than the outer container and its dispensing valve communicates with the interior of the outer container, that the dispensing valve of the inner container is kinematically coupled to the dispensing valve of the outer container in such a way that by normal actuation of the dispensing valve of the outer container the dispensing valve of the inner container is opened, and that furthermore means are provided for retaining the dispensing valve of the inner container in its open position. As such means there have been proposed retaining clips, detents, collects or the like.

A test series of devices made in accordance with the European Patent Application No. 82 102 599.6 (dual-compartment packages) has quickly shown that this device poses problems in practical use, and that for several reasons:

- expensive two-valve design including two independently movable, but kinematically coupled dispensing tubes, i.e., an inner and an outer dispensing tube;
- additional problems of corrosion and fluid-tightness in the region of the dispensing valve associated with the inner container;
- relatively high assembly expenditure for the mutual association of inner and outer dispensing valve;
- separate means for retaining the dispensing valve of the inner container in the open position thereof, wherein the proper operation of these separate means is not always ensured, in particular because of the effects of corrosion.

Additionally, the U.S. Pat. No. 3,040,991 and the CH-PS No. 382,075 are mentioned as further prior art. The device known from the first-mentioned publication comprises a dispensing valve structure which is comparable with the mentioned two-valve structure as regards the design effort. The valve body is a multi-part member, and consequently a high assembly effort is required for the mutual association of parts. Above all, however, the known valve structure is unsuitable for dispensing a liquid component from an inner container. According to the known proposal, only propellant gas is to be contained therein which upon exit from the inner container through the valve body is intended to entrain a liquid component contained in the outer container in the manner of a water jet pump.

From the second publication, i.e., the CH-PS No. 382,075, it is known to break open a sealing diaphragm of the inner container by means of the dispensing valve, i.e., by means of the dispensing tube thereof. The opening obtained thereby, however, is relatively undefined and in most cases so small that spontaneous intermixing of the components in the inner and outer container does not occur.

The present invention is based on the object of providing a device which is of simple design and yet functions extremely reliably, and in which a defined fluid communication between the inner and outer container may be established so that uniform good mixing of the components is ensured.

This object is solved in accordance with the invention by the use of only a single dispensing valve, the valve body thereof additionally having the function of the separate dispensing valve associated with the inner container as specified in the European Patent Application No. 82 102 599.6. Due to this constructional measure the device according to the instant invention has a minimum of parts while the operational reliability is even improved. There are no problems of corrosion at all in the region of the dispensing opening of the inner container which might in any way affect the opening of the inner container. Finally, with the device according to the invention a spontaneous and relatively large-sized opening of the inner container is ensured.

In another important embodiment, the inner aerosol valve according to the European Patent Application No. 82 102 599.6 is replaced by a special closure member including a sealing diaphragm adapted to be urged into the container opening by the dispensing tube of the dispensing valve, wherein means for locking the sealing diaphragm, preferably in the form of retaining ribs, cams or the like, are provided in the container opening of the inner container so as to obtain a defined fluid communication between the inner and the outer container. Accordingly, in the instant invention the sealing diaphragm is an integral part of the closure member of the inner container, wherein the latter is preferably held between the valve body of the dispensing valve and the edge of the opening of the inner container. Locking takes place, for instance, by means of a resilient element which urges the inner container including the closure member against the valve body of the dispensing valve.

In another important embodiment, it is possible, on the one hand, to fill the inner container in its already assembled state within the outer container. On the other hand, after filling of the inner container a fluid-tight seal between the interior of the inner container and the interior of the outer container is ensured. Above all, these measures are suitable for filling the inner container with the propellant.

BRIEF DESCRIPTION OF THE DRAWING

Below, embodiments of the device in accordance with the invention will be described in detail with reference to the accompanying drawing, in which.

DESCRIPTION OF THE PREFERRED EMBODIMENT

Figure 1:
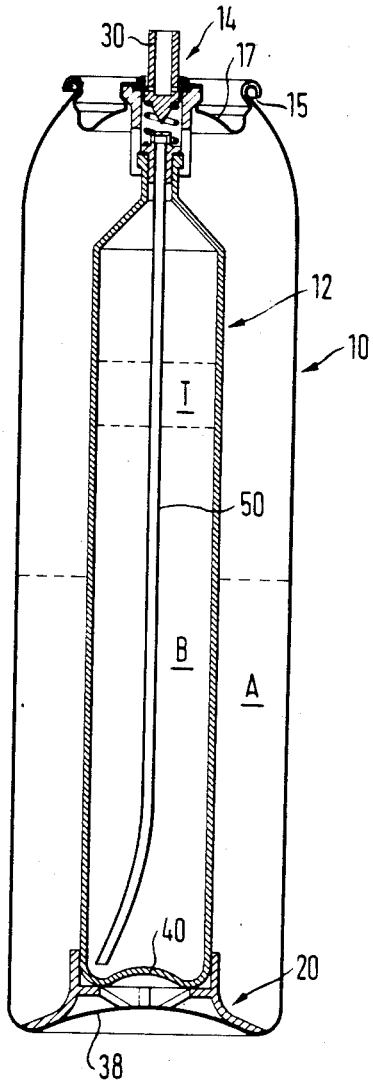
FIG. 1 is a longitudinal or axial section through the device of the instant invention or, respectively, a dual-compartment container configured in accordance with the invention.

The device or dual-compartment container shown in FIG. 1 comprises an outer standard-type aerosol container 10 including a dispensing valve 14 retained in the usual way in a cover 17, which is sealingly secured to the edge 15 of the mouth of the container 10, and further comprises an inner container 12 made of a material of the same corrosion-resistant quality as the outer container 10. The outer container 10 contains a component A, while the inner container 12 contains a component B as well as a suitable propellant T, which normally is a readily liquefiable gas such as butane-propane gas or the like. The inner component may, for instance, be hydrogen peroxide, while the component A may be a dye. The container dimensions are adapted to the volumes of the contents to be dispensed and to the proportions thereof. The maximum diameter of the inner container 12 may be almost as large as that of the periphery 15 of the opening of the outer container 10 so that the inner container 12 may still be inserted through said opening into the outer container. With common sizes these dimensions are standardised.

The dispensing valve 14 mounted in the cover 17 comprises a valve body 18 and an actuating and dispensing tube 30 mounted in said body for axial inward movement, through which tube the mixture may be discharged from the containers 10, 12. The dispensing tube 30 is movable against the action of a helical spring 46 in axially inward direction, the helical spring 46 being supported by the valve body 18, on the one hand, and by an annular shoulder 48 integrally formed with the discharge tube 30, on the other hand. As will be clearly apparent from FIGS. 2 and 3, the valve body 18 is anchored in the cover 17 as a non-positive form-fit. As is equally apparent from FIGS. 2 and 3, the edge 24 of the opening of the inner container 12 is in fluid-tight engagement with the valve body 18 of the dispensing valve 14, and between the valve body 18 and the edge 24 of the opening there is disposed an annular sealing member 34 made of a preferably elastic and corrosion-resistant material such as rubber or plastics. In the embodiment shown in FIGS. 2 and 3 the edge 24 of the opening of the inner container 12 is provided with a continuous engaging ridge 36 on the side facing the annular sealing member 34, said ridge 36 ensuring absolute fluid-tightness also at elevated pressures. The valve body 18 at the same time functions as closure member 41 and as upper mounting member (the valve body 18 is downwardly extended extension 57) and may receive and support the inner container 12 in snap-engagement for insertion into the outer container 10) for the inner container 12, wherein the portion which closes the opening of the inner container 12 is adapted to be broken open by means of an actuating member 16 operatively connected to the dispensing tube 30 of the dispensing valve 14. Said actuating element is configured as a breaking tip 44—optionally provided with integral lateral knife-like cutting edges—and is integral with the underside of the dispensing tube 30 or the side of the tube facing the opening of the inner container 12, respectively. The closing portion of the valve body 18 is configured as dispensing tube including a sealing diaphragm 28, thereby forming a container discharge opening 26; a hose-like riser tube 50 is connected to said dispensing tube and extends to near the bottom 40 of the inner container 12. Thus, the vavle body 18 functions simultaneously as a kind of "sealing cap" of the inner container with a sealing diaphragm 28 adapted to be broken by the breaking tip 44. The sealing diaphragm 28 and the sidewall 54 of the portion of the valve body 18 forming the dispensing tube, which portion extends beyond the edge 24 of the opening of the inner container 12, each have a somewhat reduced wall thickness relative to the other portions of the valve body 18 (about half the thickness of the latter portions), whereby during emptying of the content of the inner container 12, i.e., upon exit of the overpressurized component B from the inner container 12, the discharge opening 52 is "spread apart" or "expanded". Thereby a large-area discharge opening 52 is obtained which allows a relatively spontaneous and good mixing of the components A and B.

Figure 2:
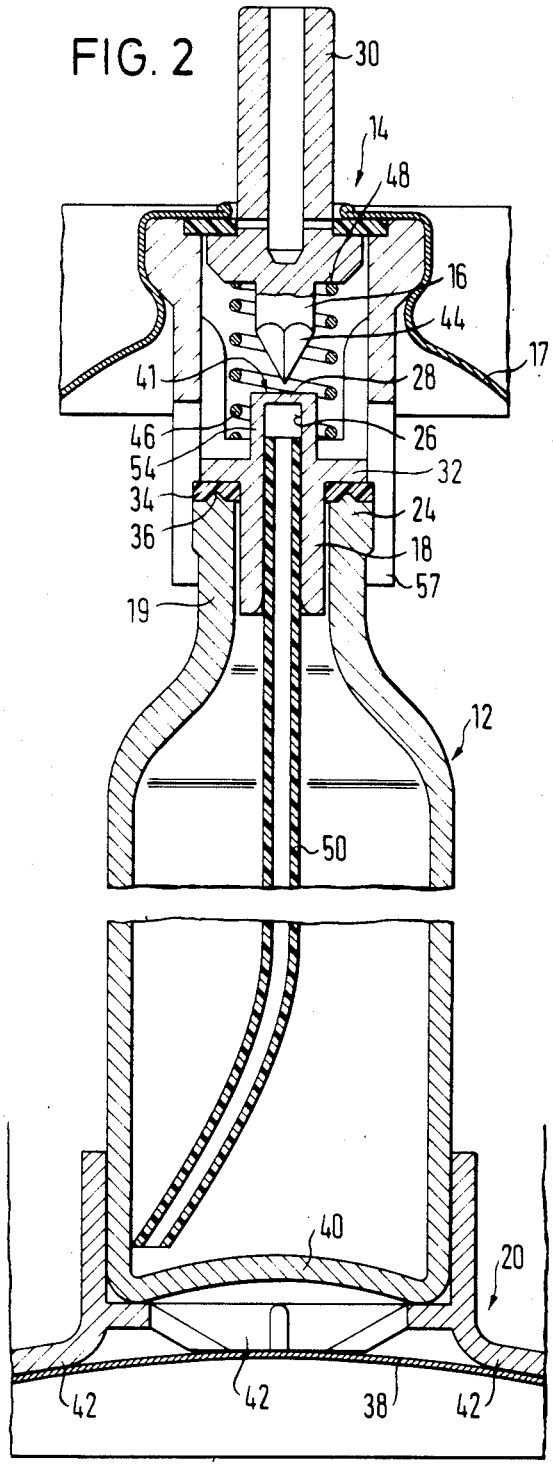
FIG. 2 is a longitudinal or axial section at an enlarged scale showing the dispensing valve and the mounting of the inner container within the outer container before the inner container is opened.
Figure 3:
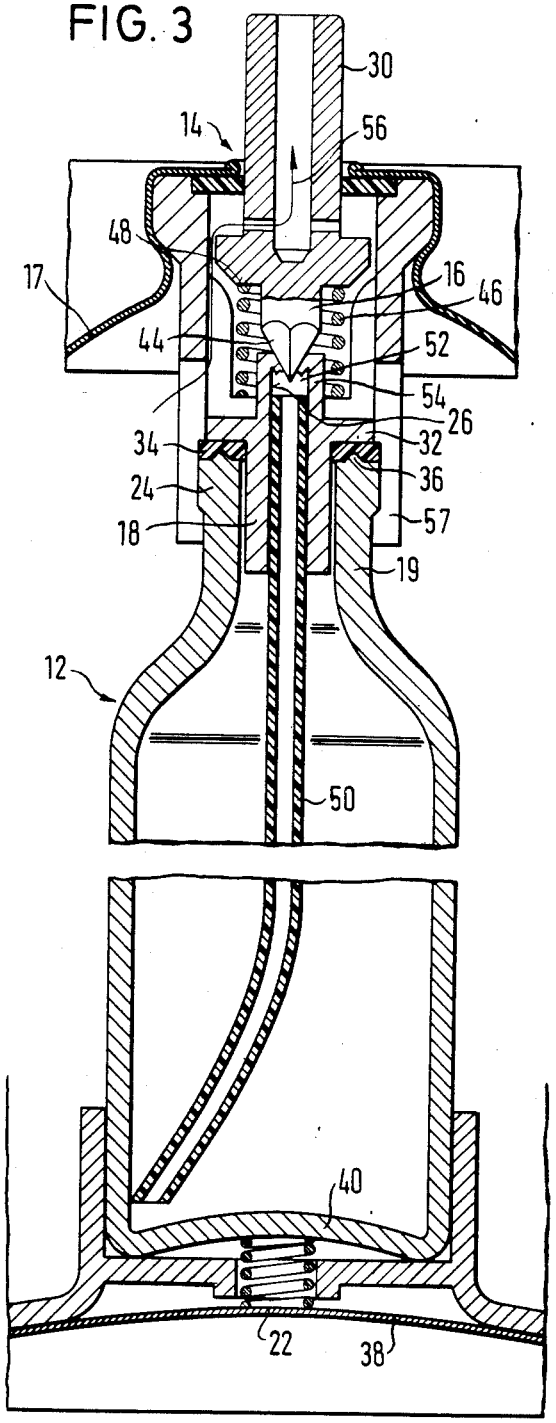
FIG. 3 is a view showing the dispensing valve and the inner container according to FIG. 2, but after the inner container has been opened, with a somewhat modified support of the inner container within the outer one.

In the embodiment shown in FIGS. 1 to 3, the inner container 12 and the edge 24 of its opening are urged by the action of a resilient element 20 or 22, respectively, against the valve body 18, i.e., an annular shoulder 32 thereof. The pressure force of the resilient element 20 or 22 is sufficiently high so that a reliable sealing effect relative to the filled space of the outer container 10 is obtained between the annular shoulder 32 of the valve body 18 and the edge 24 of the opening of the inner container 12 including the annular sealing member 34. Besides, in the embodiment shown, the inner container 12 is of bottle-like configuration.

In the embodiment shown in FIG. 2 the resilient element is constituted by a cup-like supporting means 20 encompassing the bottom area of the inner container 12 and having feet 42 resiliently supported in respect of the side and bottom walls of the outer container 10. Thus, the cup-like supporting means 20 at the same time has the function of locating the inner container 12 within the outer container 10 and of resiliently acting against the annular shoulder 32 of the valve body 18.

In the embodiment shown in FIG. 3 the resilient engagement of the inner container 12 or of the edge 24 of the opening thereof against the annular shoulder 32 of the valve body 18 is effected by a spring, viz., the helical spring 22, acting between the bottom 38 of the outer container 10 and the bottom 40 of the inner container 12. For the rest, the inner container 12 is located within the outer container 10 in the bottom area of the inner container 12 in the same way as in the embodiment of FIG. 2, i.e., by means of a cup-like supporting means encompassing the bottom area of the inner container 12 and supported by means of lateral integral feet with respect to both the side and the bottom walls 38 of the outer container 10.

In the unused condition of the device or dual-compartment container, the dispensing tube 30 takes the position shown in FIG. 1 and FIG. 2, respectively. When the two components A and B are to be mixed, the dispensing tube 30 of the dispensing valve 14 is pressed axially inwardly whereby the sealing diaphragm 28 is broken. Since the outer container 10 is unpressurized, component A contained therein will not exit therefrom in spite of the briefly opened valve 14. As long as the dispensing tube 30 is pressed inwardly with its breaking tip 44, the latter seals the broken dispensing opening 52 of the inner container 12 relatively well so that component B contained in the inner container 12 also cannot exit therefrom (FIG. 3). But as soon as the dispensing tube 30 of the dispensing valve 14 is released, the breaking tip 44 will be lifted and the dispensing opening 52 will be exposed. The inner container 12, which is pressured by the propellant T, is abruptly emptied through the riser tube 50 and the dispensing opening 52 which—as already described—is expanded outwardly due to the selected wall thickness of the sealing diaphragm 28 and the contiguous side wall 54 of the portion of the valve body 18 used as dispensing tube. At this time the dispensing valve 14 is already closed again, so that also during this stage no part of the contents may exit from the outer container 10. After briefly shaking the device so as to blend the two components A and B, the mixture may be dispensed in the usual way be renewed actuation of the dispensing tube 30. From the described mode of operation it will be apparent that in spite of the extremely simple structure any maloperations that might cause undesirable leakage of fluid are impossible.

The device or dual-compartment container shown in FIG. 5 again comprises an outer standard-type aerosol container 10 including a dispensing valve 14, which is conventionally retained in a cover 17 sealingly secured to the edge 15 of the opening of the outer container 10, and an inner container 12 which is made of a material of the same corrosion-resistant quality as the outer container 10. As in the preceding embodiments, the outer container 10 contains a component A, while the inner container 12 contains a component B and a suitable propellant T.

The dispensing valve 14 secured in the cover 17 comprises a valve body 18 and an actuating and dispensing tube 30 mounted therein for axial inward movement, through which the mixture may be dispensed from the containers 10, 12. The dispensing tube 30 is additionally closed by a cap 39. The dispensing tube 30 is movable axially inwardly against the action of a helical spring 46, wherein the helical spring 46 is supported by the valve body 18, on the one hand, and by an annular shoulder 48 integrally formed with the dispensing tube 30, on the other hand (as in the embodiments of FIGS. 1 to 3). The valve body 18 is anchored non-positively and as a form-fit in the cover 17. The inner container 12 is configured like a bottle with a tapering bottle neck 19. As will be clearly apparent from FIGS. 5 to 8, the closure means 41 of the inner container is configured as closure hood turned upside down over the edge 24 of the opening of the bottle neck 19. The fluid-tight seal between the interior of the inner container and the interior of the outer container is obtained by means of an annular sealing member 34 disposed between the edge 24 of the opening and the closure hood 41; the additional function of the sealing member will be explained in detail with reference to FIGS. 7 and 8. The closure hood 41 is clamped between the edge 24 of the opening of the inner container 12 or the annular sealing member 34, respectively, and the valve body 18 of the dispensing valve 14, the clamping action being obtained by a resilient element acting on the bottom of the inner container 12 and at the same time functioning as lower support and centering the inner container 12 within the outer container 10. The pressure force of said resilient element 20 is sufficiently large, so that a reliable sealing effect is obtained relative to the filled volume of the outer container 10 between the closure hood 41 and the edge 24 of the opening of the inner container 12 including the annular sealing member 34.

In the illustrated embodiment, the resilient element 20 is constituted similar to that of FIG. 2 by a cup-like supporting means encompassing the bottom area of the inner container 12 and having feet 42 elastically supported relative to the side and bottom walls of the outer container 10. The cup-like supporting means simultaneously functions to locate the inner container 12 within the outer container 10 and to resiliently act against the closure member 41 or the valve body 18 of the dispensing valve. To secure the closure hood 41 during assembly on the edge 24 of the opening of the inner container 12 or the bottle neck 19 thereof, respectively, the lower edge of the closure hood 41 is provided with inwardly protruding locking bosses or an inwardly protruding locking bead 23, which engage behind the edge 24 of the opening (see FIGS. 5 to 8). Actual fixing of the closure hood 41 in the filled condition of both containers is effected, however, by clamping it between the edge 24 of the opening of the inner container 12 and the valve body 18 of the dispensing valve 14, as has been explained above.

The resilient urging of the inner container 12 or the edge 24 of the opening thereof against the closure hood 41 and thus against the valve body of the dispensing valve 14 may also be effected in a way similar to FIG. 3 by a spring member, e.g. a helical spring, acting between the bottom of the outer container 10 and the bottom of the inner container 12.

Figure 4:
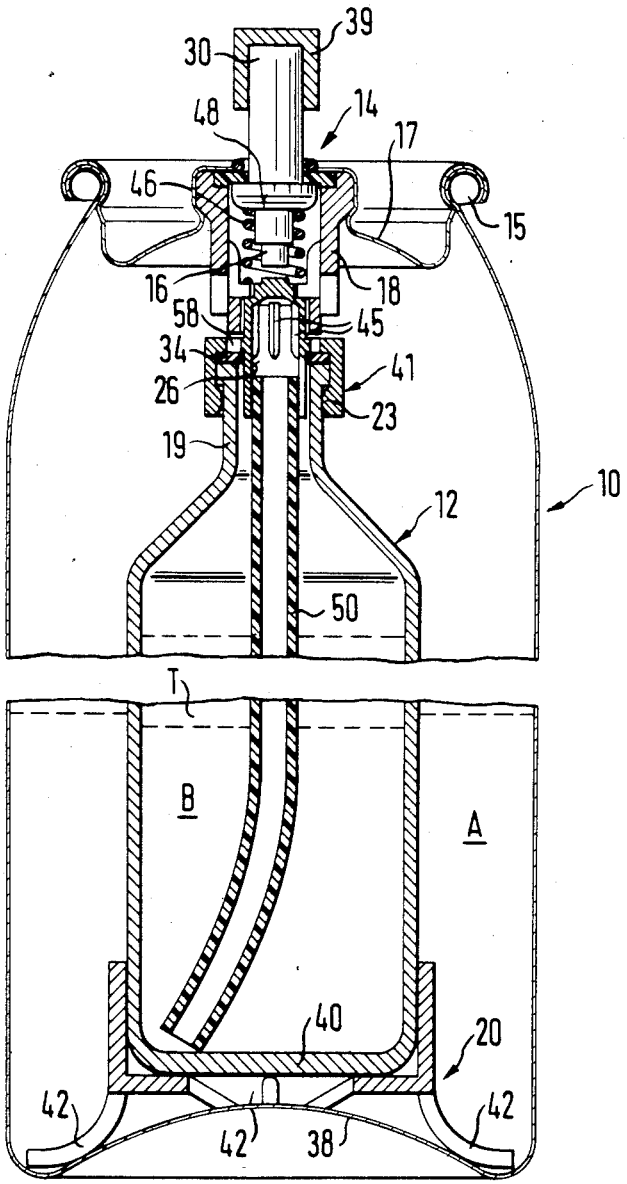
FIG. 4 is a longitudinal or axial section through a modified device or a modified dual-compartment container including features in accordance with the invention.
Figure 5:
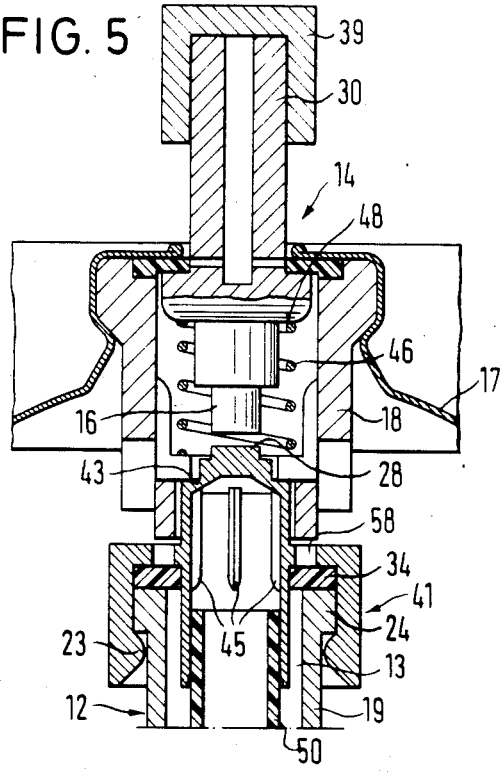
FIG. 5 is a longitudinal sectional view of the opening and mixing mechanism of the device of FIG. 4 at an enlarged scale, wherein the closure means of the inner container is sealed in a fluid-tight way.
Figure 6:
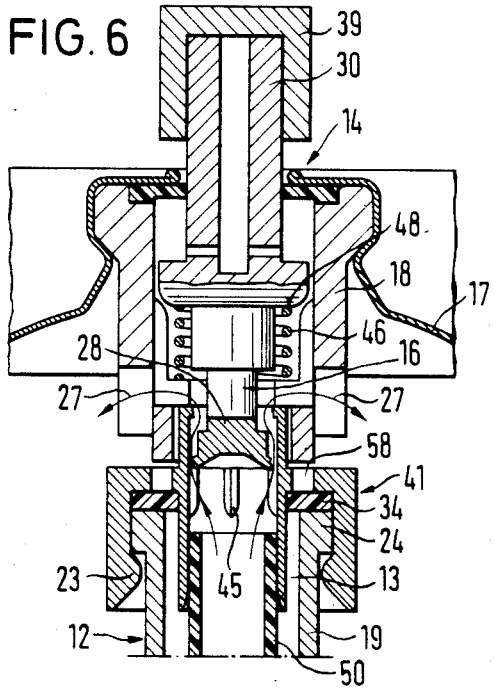
FIG. 6 is a view of the opening and mixing mechanism of FIG. 5 with the closure means of the inner container broken open.

When the device is not in use, the dispensing tube 30 takes the position shown in FIG. 4 and FIG. 5, respectively. When the two components A and B are to be mixed, the dispensing tube 30 of the dispensing valve 14 is pressed axially inwardly, whereby a predetermined annular breaking point 43 of a cap-like sealing diaphragm 28 is broken and the diaphragm is pushed into a central passage, which in the illustrated embodiment defines the component exit opening 26 of the inner container 12 and is an integral part of the closure hood 41. The broken or open condition of the inner container 12 is illustrated in FIG. 6. As will be readily apparent from the FIGS. 5 to 8, the sealing diaphragm 28 is an integral part of the closure hood 41 and is joined thereto via a predetermined breaking point configured as a weak annular point 43. The sealing diaphragm 28, which has been pushed or pressed into the opening 26 by means of the dispensing tube 30, is retained in said opening by means of three circumferentially equispaced longitudinal ridges 45, thereby establishing a defined fluid communication between the interior of the inner container and the interior of the outer container (arrow 27 in FIG. 6). For the rest, a conventional riser tube 50 is connected to the passage defining the container exit opening 26. For the purpose of breaking the closure hood 41, i.e., for pressing the sealing diaphragm 28 inwardly, the lower actuating portion 16 of the dispensing tube 30 facing the diaphragm 28 is configured as a plunger.

Figure 7:
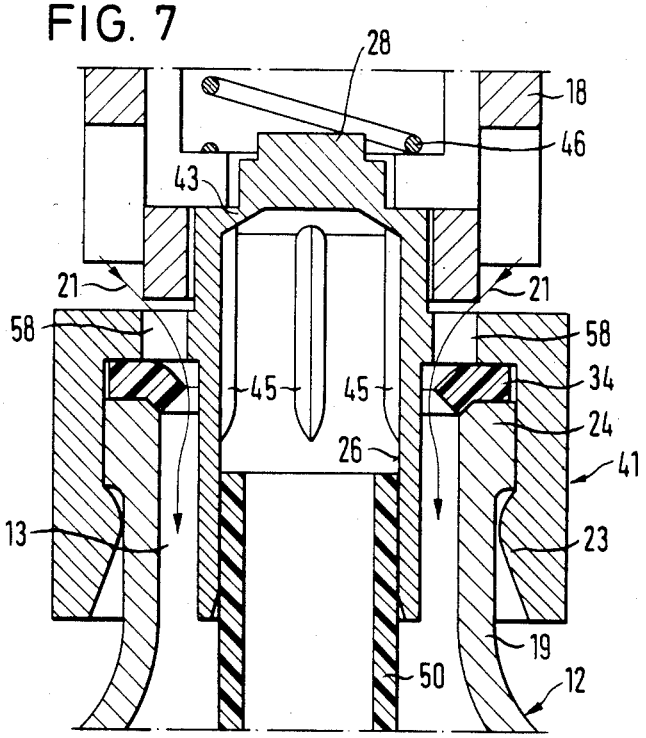
FIG. 7 is a sectional view at a still further enlarged scale showing the closure means of the inner container of FIGS. 4 to 6 so as to illustrate filling of the inner container with a propellant.
Figure 8:
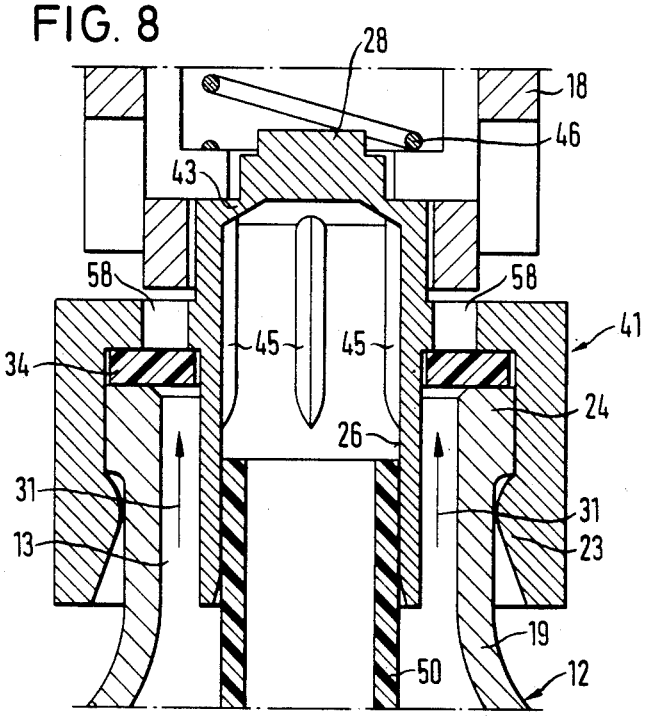
FIG. 8 is a view of the closure means of the inner container of FIG. 7 after the inner container has been filled with propellant.

The dual function of the annular sealing member 34 will be explained in detail with reference to FIGS. 7 and 8. The annular sealing member 34 acts simultaneously as a check valve. For the purpose of filling the inner container 12 with propellant in the already assembled state of the container (arrows 21 in FIG. 7) the closure hood 41 is provided with apertures 58 disposed in the region of an annular gap 13 between the central passage defining the container opening 26 and the bottle neck 19 of the inner container 12. The closed position of the annular sealing member 34 is shown in FIG. 8. The propellant in the interior of the inner container 12 urges the annular sealing member 34 upwards such that the passages 58 in the closure hood 41 are closed. The direction in which the propellant T acts is indicated in FIG. 8 by the arrows 31. When the inner container 12 is filled with propellant (arrows 21 in FIG. 6) through the apertures 58, the annular sealing member 34 will be urged inwardly into the annular gap 13 to thereby establish fluid communication between the apertures 58 and the annular gap 13. Accordingly, the annular sealing member 34 has a dual function. Instead of the annular sealing member 34 it is also possible to provide ball check valves or shutoff diaphragms in the apertures 58. The embodiment shown in FIGS. 7 and 8 and including the annular sealing member 34 is, however, the most simple solution possible from the aspect of design effort.

The closure hood 41 according to FIGS. 4 to 8 may also be an integral part of the valve body 18, and the principle of solution illustrated in FIGS. 1 to 3 would then be applied accordingly.

Figure 11:
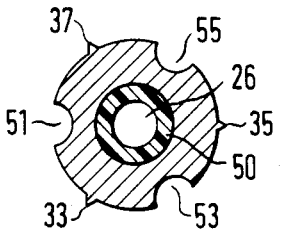
FIG. 11 is a cross-sectional view along the line IX-IX of FIG. 9, showing the closure means of the inner container.
Figure 9:
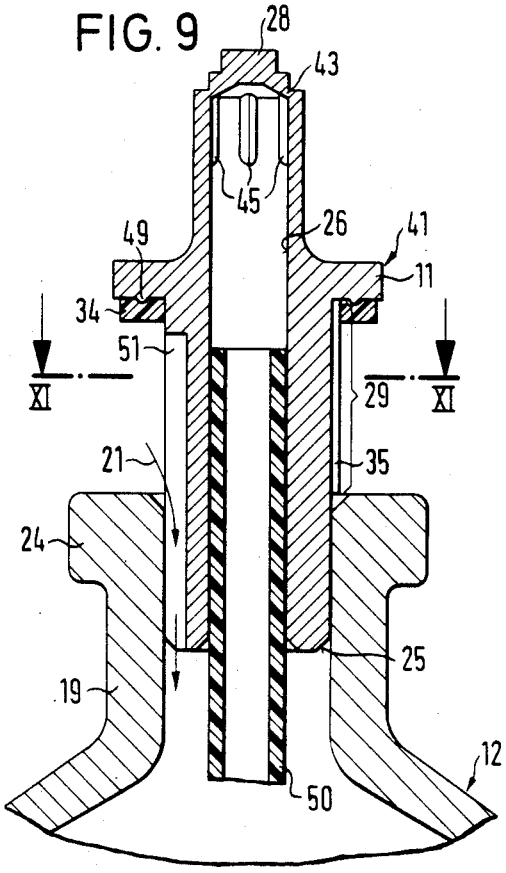
FIG. 9 is a sectional view of a still further modified closure means of the inner container, illustrating filling of the inner container with a propellant.
Figure 10:
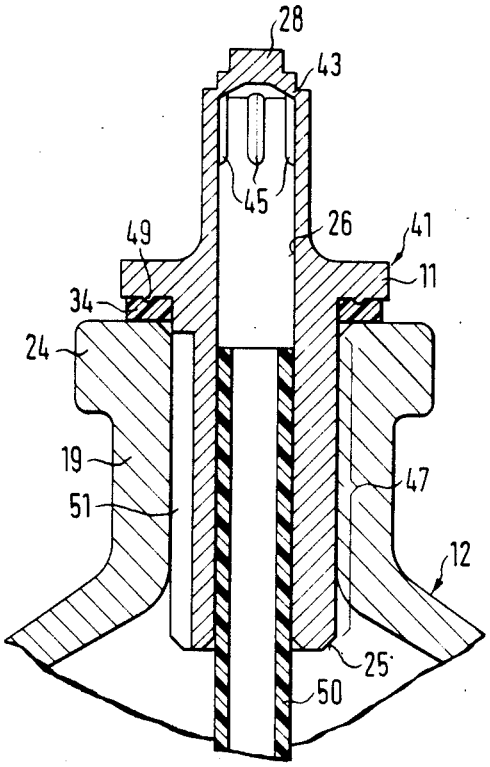
FIG. 10 also is a longitudinal or axial sectional view of the closure means of the inner container of FIG. 9 after the inner container has been filled with propellant.

In the embodiment illustrated in FIGS. 9 to 11 the closure member 41 of the inner container 12 is provided with three circumferentially equispaced outer longitudinal grooves 51, 53, 55 for filling the container with propellant (arrows 21), each of said grooves extending almost along the entire length of the closure portion 47 which projects into the inner container 12 when the latter is in the fully assembled or closed state after having been filled (see FIG. 10). The filling operation of the inner container 12 is as follows:

Initially, the liquid component B is filled into the inner container 12. Then the closure member 41 according to FIG. 9 is placed in the opening of the inner container 12 configured like a bottle neck 19 such that the longitudinal grooves 51, 53 and 55 ensure fluid communication between the interior of the inner container and the outer environment. Then, liquid propellant is filled by means of a filling head through the longitudinal grooves 51, 53, 55 into the interior of the inner container 12 (arrows 21). When the filling operation is completed, the closure member 41 is pushed or urged by the filling head completely into the opening of the inner container 12 according to FIG. 10, whereby three longitudinal ribs 33, 35, 37, which are equidistantly spaced about the outer circumference of the closure portion 47 and are each provided between two respective longitudinal grooves 51, 53 and 55, are subjected to elastic deformation to thereby retain the closure member 41 in the container opening in fluid-tight relationship so as to seal the longitudinal grooves 51, 53, 55. The length 29 of the ribs 33, 35, 37 corresponds to about half the length of the portion 47 of the closure 41 projecting into the inner container 12. The annular sealing member 34 is configured similar to that shown in FIGS. 1 to 3, and in the closed condition of the inner container 12 it is in fluid-tight engagement with the edge 44 of the opening thereof, on the one hand, and with an annular shoulder 11 provided on the closure member 41, on the other hand (see FIG. 10), the annular shoulder 11 on its side facing the annular sealing member 34 being provided with a continuous pressing ridge 49 which ensures absolute tightness also at elevated pressures in the interior of the inner container.

The longitudinal grooves are intended to retain the closure member 41 securely in fluid-tight relationship in the opening of the inner container 12 only until the inner container 12 has been inserted into the outer container (not illustrated in FIGS. 9 to 11) and has been located therein in the manner explained before in conjunction with the embodiment illustrated in FIGS. 1 to 3 and 4, respectively. A permanent fluid-tight seal between the interior of the inner container and the interior of the outer container is ensured only by the clamped condition of the closure member 41 between the edge 24 of the opening of the inner container 12 and the valve body of the dispensing valve.

As will be apparent from FIG. 9, the three longitudinal ribs 33, 35 and 37 each extend downwardly from the annular shoulder 11 towards the free end of the closure portion 47 projecting into the container opening, wherein—as explained above—the longitudinal extension 29 of each rib 33, 35, 37 corresponds to about half the length of the closure portion 47 which projects into the container opening or the inner container 12, respectively.

The cap-like sealing diaphragm 28 and its connection with the remaining closure body via the predetermined annular breaking point 43 and the diaphragm positioning ridges 45 are similar to the embodiment illustrated in FIGS. 4 to 8, so that reference is made to the corresponding explanations.

In the embodiment according to FIGS. 9 to 11, the container exit opening is also constituted by the axial passage 26 of the closure member 41. As in the previously described embodiments, the riser tube 50 is secured therein in a press fit.

All of the features disclosed in the present papers are claimed as being essential to the invention insofar as they are novel over the prior art either individually or in combination.

I claim:

1. A device for mixing and spraying a mixture composed of at least two components, such as liquids, and of a propellant, comprising an inner container and an outer container for receiving the components to be mixed and the propellant, wherein the inner container has an opening at one end and is supported within the outer container, and a dispensing valve which is mounted on the outer container and which includes a valve body and a movably mounted dispensing tube which is supported by the valve body, wherein the dispensing tube is engageable at one end with a closure member that is integrally formed with the valve body and which seals the inner container opening such that the longitudinal axs of the valve body, the dispensing tube and the closure member are in alignment, wherein the engageable end of the dispensing tube is in the form of a breaking tip whereby axial inward movement of the dispensing tube against the closure member breaks opening the closure member in such a way that the inner container may be broken open by the normal inward actuation of the dispensing tube, wherein a top edge of the opening of the inner container is urged against an annular shoulder of the valve body by action of a cup-shaped supporting member against the inner container bottom so that the edge of the opening of the inner container is in fluid tight engagement with the valve body of the dispensing valve, and wherein the cup-shaped supporting member has feet elastically supported relative to the side and bottom wall of the outer container and encompasses and supports a bottom area of the inner container so that the inner container is supported within the outer container.

2. A device as claimed in claim 1, wherein an elastic compressible annular sealing member is disposed between the edge of the opening of the inner container and the annular shoulder of the valve body.

3. A device as claimed in claim 2, wherein the edge of the opening of the inner container is provided on a side facing the annular sealing member with at least one continuous contact ridge.

4. A device as claimed in claim 1, wherein the dispensing tube is movable in an axially inward direction against the action of a spring, to thereby establish fluid communication with the outside, wherein the spring is supported by the valve body, on the one hand, and by an annular shoulder integrally formed with the dispensing tube, on the other hand.

5. A device for producing and spraying a mixture composed of at least two components, such as liquids, and a propellant, comprising an inner container and an outer container, wherein the inner container has an opening at one end and is supported within the outer container, for receiving the components to be mixed and the propellant, and a dispensing valve which is mounted on the outer container and which includes a valve body and a movably mounted dispensing tube which is engageable at one end to a closure member, wherein the closure member closes the inner container opening and includes means for permitting the displacement of a portion thereof toward the interior of the inner container by actuation of the dispensing valve such that inward axial movement of the dispensing tube engages and then displaces the portion of the closure member toward the interior of the inner container in such a way that the inner container may be broken open by normal actuation of the dispensing valve, wherein the longitudinal axes of the valve body, dispensing tube and closure member are in alignment, wherein the portion of the closure member of the inner container comprises a cap-like sealing diaphragm which is displaceable into the opening of the inner container by axial inward movement of the dispensing tube of the dispensing valve against the closure member, and wherein the inner container also includes means for fixing the cap-like sealing diaphragm when the cap-like sealing diaphragm is displaced into the opening of the inner container, whereby a fluid communication between the interior of the inner container and the interior of the outer container is established and maintained.

6. A device as claimed in claim 5, wherein the closure member of the inner container is provided with a central passage defining the container opening, the passage being sealed by the sealing diaphragm.

7. A device as claimed in claim 6, wherein externally of the central passage sealed by the sealing diaphragm, the closure member is formed with a further passage which communicates at one end with a check valve and at the other end with the interior of the inner container, wherein the check valve is reversibly held in a closed position by the pressure existing in the filled inner container and which is reversible to an open position for the purpose of filling the inner container.

8. A device as claimed in claim 7, wherein the check valve includes an annular sealing member disposed between the closure member and edge of the inner container.

9. A device as claimed in claim 7 or claim 8, wherein a resilient element is positioned between the inner and outer containers such that under the action of the resilient element supported by the outer container the closure member is urged against the edge of the opening of the inner container and closes the inner container, whereby a fluid-tight seal is formed between the inner and the outer container.

10. A device as claimed in claim 9, wherein the closure member of the inner container is retained in clamped relationship between the inner container and the valve body of the dispensing valve.

11. A device as claimed in claim 5, wherein the means for fixing the sealing diaphragm when it has been displaced into the opening of the inner container includes at least three longitudinal ribs approximately equidistantly distributed about the circumference of a central passage defining the opening of the inner container.

12. A device as claimed in claim 5, wherein the means permitting the displacement of the portion of the closure member comprises a weak annular breaking point between the sealing diaphragm and the remaining portion of the closure member of the inner container.

13. A device as claimed in claim 5, wherein, for the purpose of filling the inner container, the closure member is provided with a plurality of external longitudinal grooves approximately equidistantly spaced about its circumference, each of the grooves extending almost over the entire length of a closure portion of the closure member, wherein the closure portion is that extension of the closure member which projects into the inner container when the closure member closes the inner container opening.

14. A device as claimed in claim 13, wherein the closure portion of the closure member is provided on the outer circumference thereof with a plurality of elastically deformable longitudinal ridges which are equidistantly spaced about the circumference and are each provided between two of the longitudinal grooves, wherein the plurality of longitudinal ridges are elastically deformed by urging of the closure member, after filling of the inner container through the longitudinal grooves, into the opening of the inner container, thereby retaining the closure member in fluid-tight relationship with the inner container and sealing the plurality of longitudinal grooves.

15. A device as claimed in claim 14, wherein the length of the plurality of longitudinal ridges corresponds to about half the length of the closure portion.

16. A device as claimed in claim 5, wherein the means for fixing the sealing diaphragm when it has been displaced into the opening of the inner container includes at least three retaining bosses, approximately equidistantly distributed about the circumference of a central passage defining the opening of the inner container.

* * * * *